US008439469B2

(12) United States Patent
Itogawa

(10) Patent No.: US 8,439,469 B2
(45) Date of Patent: May 14, 2013

(54) LIQUID EJECTING APPARATUS

(75) Inventor: Yoshihiro Itogawa, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 307 days.

(21) Appl. No.: 12/888,511

(22) Filed: Sep. 23, 2010

(65) Prior Publication Data

US 2011/0074851 A1 Mar. 31, 2011

(30) Foreign Application Priority Data

Sep. 30, 2009 (JP) ..... 2009-227426

(51) Int. Cl.
*B41J 29/38* (2006.01)

(52) U.S. Cl.
USPC ..... 347/14

(58) Field of Classification Search ..... 347/5, 9, 347/14
See application file for complete search history.

(56) References Cited

U.S. PATENT DOCUMENTS

| | | | |
|---|---|---|---|
| 5,659,342 | A | 8/1997 | Lund et al. |
| 7,699,426 | B2 | 4/2010 | Matsumoto et al. |
| 7,726,768 | B2 | 6/2010 | Tsuchii |
| 2006/0279600 | A1 | 12/2006 | Matsumoto et al. |
| 2007/0139452 | A1 | 6/2007 | Yamane |
| 2008/0174632 | A1 | 7/2008 | Miyamoto et al. |
| 2009/0267981 | A1 | 10/2009 | Tsuchii |
| 2011/0050768 | A1 * | 3/2011 | Itogawa ..... 347/9 |

FOREIGN PATENT DOCUMENTS

| | | | |
|---|---|---|---|
| JP | 8-112904 | | 5/1996 |
| JP | H08-216394 | A | 8/1996 |
| JP | H09-063147 | A | 3/1997 |
| JP | H09-277569 | A | 10/1997 |
| JP | 2001-063147 | A | 3/2001 |
| JP | A-2002-178534 | | 6/2002 |
| JP | 2005-165407 | A | 6/2005 |
| JP | 2006-341519 | A | 12/2006 |
| JP | 2007-136772 | A | 6/2007 |
| JP | 2007-160539 | A | 6/2007 |
| JP | 2007-185957 | | 7/2007 |
| JP | 2008-179011 | | 8/2008 |

OTHER PUBLICATIONS

Japanese Patent Application Publication No. JP-A-2002-178534, published Jun. 26, 2002, together with an English-language abstract and computer-generated English translation; and.

(Continued)

*Primary Examiner* — Laura Martin
(74) *Attorney, Agent, or Firm* — Scully, Scott, Murphy & Presser, PC

(57) ABSTRACT

A liquid ejecting apparatus, including: a feeding mechanism which feeds a recording medium; a first ejection head including a first ejection opening for ejecting first liquid and a first energy generating portion which generates an energy for ejecting the first liquid; an image-data storage section storing image data for ejecting the first liquid onto dot areas on the recording medium; an image-recording controlling section which controls the first energy generating portion based on the image data; a flushing-data producing section which produces flushing data for flushing; and a flushing controlling section which controls the first energy generating portion such that a flushing dot is formed on the recording medium, wherein the flushing-data producing section produces the flushing data such that the flushing dot is landed on one of the dot areas which is distant, by a specific area, from an edge dot area corresponding to an edge of the image.

20 Claims, 10 Drawing Sheets

OTHER PUBLICATIONS

Notification of Reason for Refusal dated Aug. 23, 2011 received from the Japanese Patent Office from related Japanese Application No. 2009-227426, together with an English-language translation.

Japanese Patent Application Publication No. JP-2007-136772-A, published Jun. 7, 2007, together with an English-language abstract and computer-generated English translation.

Japanese Patent Application Publication No. JP-2006-341519-A, published Dec. 21, 2006, together with an English-language abstract, corresponding to United States Patent Application Publication No. US 2006/0279600 A1, published Dec. 14, 2006 to Matsumoto et al. and United States Patent No. 7,699,426 B2, dated Apr. 20, 2010 to Matsumoto et al.

Japanese Patent Application Publication No. JP-2001-063147-A, published Mar. 13, 2001, together with an English-language abstract and computer-generated English translation.

Japanese Patent Application Publication No. JP-H09-277569-A, published.Oct. 28, 1997, together with an English-language abstract and computer-generated English translation.

Japanese Patent Application Publication No. JP-2007-160539-A, published Jun. 28, 2007, together with an English-language abstract, corresponding to United States Patent Application Publication No. US 2009/0267981 A1, published Oct. 29, 2009 to Tsuchii and United States Patent No. 7,726,768 B2, dated Jun. 1, 2010 to Tsuchii.

Japanese Patent Application Publication No. JP-H08-216394-A, published Aug. 27, 1996, together with an English-language abstract and computer-generated English translation.

Japanese Patent Application Publication No. JP-2005-165407-A, published Jun. 23, 2005, together with an English-language abstract and computer-generated English translation; and.

Decision to Grant a Patent dated Dec. 20, 2011 received from the Japanese Patent Office in related Japanese Application No. 2009-227426, together with an English-language translation.

Japanese Patent Application Publication No. JP-H09-063147-A, published Mar. 7, 1997, together with an English-language abstract and computer-generated English translation; and.

Decision to Grant a Patent dated Mar. 27, 2012 received from the Japanese Patent Office in related Japanese Application No. 2011-232720, together with an English-language translation.

* cited by examiner

FIG.8

| | | INK COLOR (WEIGHT) | | | |
|---|---|---|---|---|---|
| | | BLACK (1) | MAGENTA (2) | CYAN (3) | YELLOW (4) |
| INK AMOUNT (WEIGHT) | LARGE DROPLET(1) | 1 | 2 | 3 | 4 |
| | MEDIUM-SIZE DROPLET(2) | 2 | 4 | 6 | 8 |
| | SMALL DROPLET(3) | 3 | 6 | 9 | 12 |

LIQUID EJECTING APPARATUS

CROSS REFERENCE TO RELATED APPLICATION

The present application claims priority from Japanese Patent Application No. 2009-227426, which was filed on Sep. 30, 2009, the disclosure of which is herein incorporated by reference in its entirety.

BACKGROUND OF THE INVENTION

1. Field of the Invention

The present invention relates to a liquid ejecting apparatus including a recording head configured to eject ink droplets to form image dots and flushing dots on a recording medium.

2. Description of the Related Art

In general, an ink-jet printer including an ink-jet head configured to eject ink droplets from a plurality of liquid-ejection openings performs a preliminary ejection (i.e., flushing) for ejecting ink whose viscosity has been increased, in addition to a normal ejection for ejecting the ink droplets to form an image, in order to prevent clogging in the liquid-ejection openings which is caused by the ink solidified in or near the liquid-ejection openings. In a conventional printer, the preliminary ejection is performed in parallel with the image forming, and flushing dots are formed on the recording medium by the ink ejected upon the preliminary ejection.

In such a conventional printer, the flushing dots are formed near the image dots constituting the image, thereby making the flushing dots inconspicuous. Further, where a position on which the flushing dot is to be formed is adjacent to a position on which the image dot is to be formed, the position on which the image dot is to be formed is changed to the position on which the flushing dot is to be formed, and the forming of the flushing dot is canceled. As a result, there is prevented degrading of a quality of the image owing to an increase in a concentration of a part of the image, which increase is caused by mixing of the flushing dot with the image dot located near the flushing dot.

SUMMARY OF THE INVENTION

However, as described above, where the flushing dots are formed near the image dots, there arises a problem that the flushing dot is perceived and recognized as a part of an image edge, i.e., an edge portion of the image, whereby the image edge is blurred, and thus a visibility of the image edge is deteriorated. Further, a control is complicated in which the position on which the image dot is to be formed is moved to the position on which the flushing dot is to be fowled.

This invention has been developed in view of the above-described situations, and it is an object of the present invention to provide a liquid ejecting apparatus which does not require a complicated control and improves a visibility of an image edge.

The object indicated above may be achieved according to the present invention which provides a liquid ejecting apparatus, comprising: a feeding mechanism configured to feed a recording medium in a feeding direction; a first ejection head including (a) at least one first ejection opening through which is ejected first liquid for forming an image on the recording medium and (b) a first energy generating portion configured to generate an ejection energy for ejecting the first liquid through the at least one first ejection opening; an image-data storage section configured to store image data externally inputted thereto as data for ejecting the first liquid onto a plurality of dot areas into which the recording medium is partitioned such that each of the plurality of dot areas has a first length corresponding to a recording resolution in a direction perpendicular to the feeding direction and a second length corresponding to a recording resolution in the feeding direction; an image-recording controlling section configured to control the first energy generating portion of the first ejection head on the basis of the image data stored in the image-data storage section; a flushing-data producing section configured to produce flushing data for a flushing operation of the first liquid; and a flushing controlling section configured to control the first energy generating portion of the first ejection head such that a flushing dot is formed on the recording medium on the basis of the flushing data which has been produced by the flushing-data producing section, wherein the flushing-data producing section is configured to produce the flushing data such that the flushing dot is landed on one of the plurality of dot areas which is distant, by a specific area equal to or larger than at least one dot area, from an edge dot area which is a dot area corresponding to an edge of the image based on the image data stored in the image-data storage section.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIG. 8 is a table representing a relationship between (a) a color and an amount of ink ejected from liquid-ejection openings of a recording head shown in FIG. 1 and (b) brightness of a dot formed by the ejection;

DESCRIPTION OF THE EMBODIMENT

Hereinafter, there will be described an embodiment of the present invention by reference to the drawings.

Figure 1:
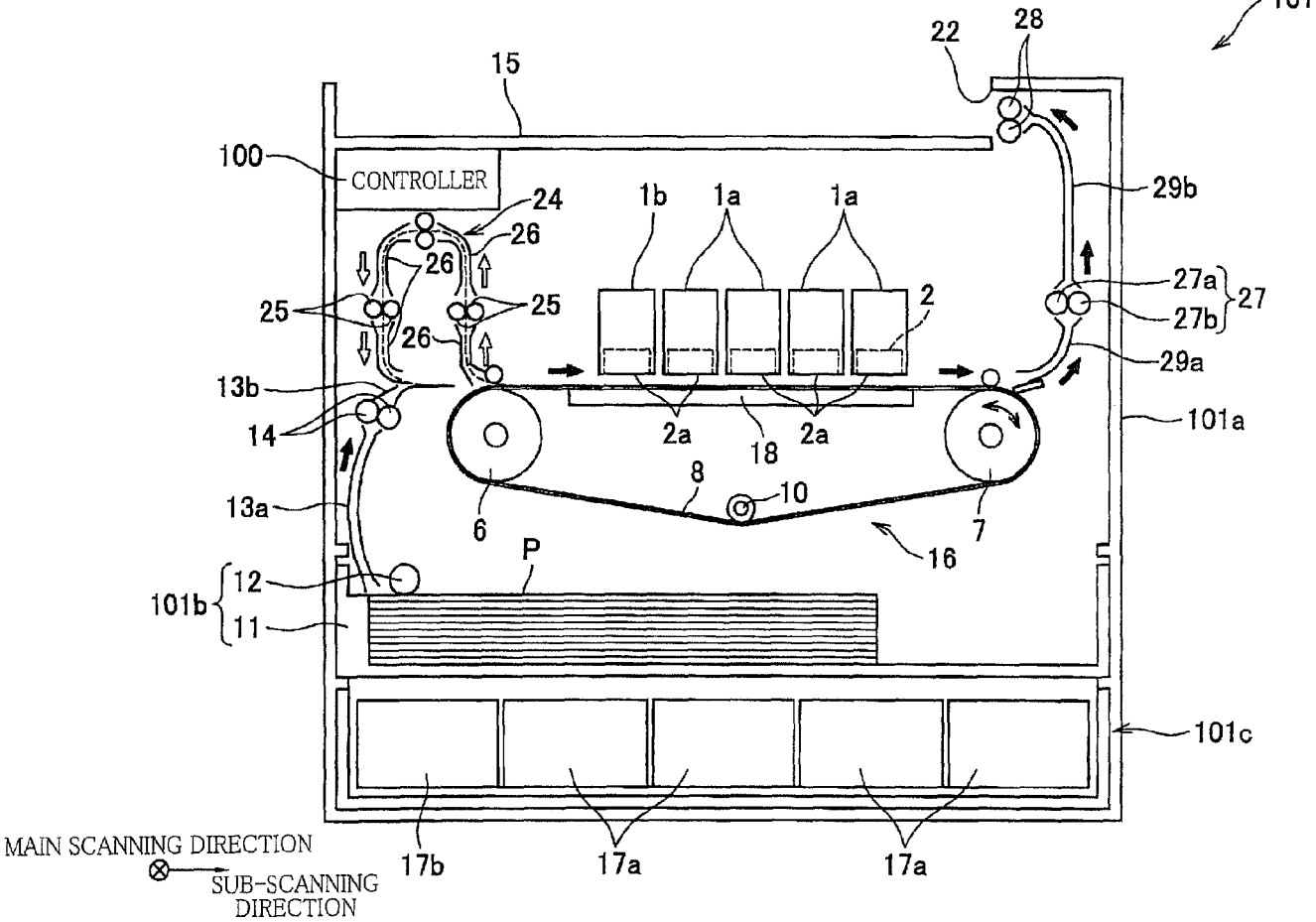
FIG. 1 is a side view generally showing an entire construction of an ink-jet printer as an embodiment of the present invention.

As shown in FIG. 1, an ink-jet printer 101 as a present embodiment includes a casing 101*a* having a rectangular parallelepiped shape. In the casing 101*a*, there are provided (a) a sheet feeding mechanism 16 configured to feed a sheet P as a recording medium in a forward sheet feeding direction which is a rightward direction in FIG. 1 or in a reverse sheet feeding direction which is opposite or reverse to the forward sheet feeding direction and (b) four recording heads 1*a* as first ejection heads and a treatment-liquid ejection head 1*b* as a second ejection head disposed on an upper side of the sheet feeding mechanism 16. The four recording heads 1*a* respectively eject ink (first liquid) of four colors, namely, cyan, magenta, yellow, and black, onto the sheet P fed in the forward sheet feeding direction by the sheet feeding mechanism 16 (that is, the forward sheet feeding direction is a direction in which the sheet P is fed when the is formed). The treatment-liquid ejection head 1*b* is located on an upstream side of the four recording heads 1*a* in the forward sheet feeding direction and configured to eject treatment liquid (second liquid) onto the sheet P fed in the forward sheet feeding direction by the sheet feeding mechanism 16. It is noted that, in the following explanation, each of the heads 1*a* and 1*b* may be simply referred to as a "head 1" without distinction because the recording heads 1*a* and the treatment-liquid ejection head 1*b* have generally the same structure.

The treatment liquid used in the present embodiment is applied or coated on the sheet P in advance to reduce a degree of permeation of the ink landed or attached later. As a result, the ink can be easily fixed on the sheet P. It is noted that there may be used treatment liquid which is to be landed on the ink ejected before for improving a degree of solidification of the ink on the sheet P, that is, post-treatment liquid may be used. Where the post-treatment liquid is used in this printer 101, the treatment-liquid ejection head 1*b* is disposed on a downstream side of the four recording heads 1*a* in the forward sheet feeding direction.

On a top plate of the casing 101*a* is provided a sheet-discharge portion 15 onto which an image-recorded sheet P is discharged. A sheet-supply unit 101*b* is disposed below the sheet feeding mechanism 16, and a tank unit 101*c* is disposed below the sheet-supply unit 101*b*. Four ink tanks 17*a* and a treatment-liquid tank 17*b* are accommodated in the tank unit 101*c*. On an upstream side of the treatment-liquid ejection head 1*b* in the forward sheet feeding direction, there is disposed a two-side recording mechanism 24 configured to turn upside down a sheet P on one side of which has been recorded the image, where image recording is performed on both sides of the sheet P, that is, two-side recording is performed.

A sheet-feed path is formed in the ink-jet printer 101 so as to extend in a direction indicated by black bold arrow. The sheet P is fed through this sheet-feed path from the sheet-supply unit 101*b* toward the sheet-discharge portion 15. The sheet-supply unit 101*b* includes a sheet-supply tray 11 and a sheet-supply roller 12. The sheet-supply tray 11 has a box shape opening upward. A plurality of sheets P are accommodated in the sheet-supply tray 11 in a state in which the sheets P are stacked one another. The sheet-supply roller 12 supplies an uppermost one of the sheets P accommodated in the sheet-supply tray 11. The supplied sheet P is fed to the sheet feeding mechanism 16 while being guided by guides 13*a*, 13*b* and nipped by a pair of sheet-feed rollers 14.

The sheet feeding mechanism 16 includes two belt rollers 6, 7, a sheet-feed belt 8, a tension roller 10, and a platen 18. The sheet-feed belt 8 is an endless belt wound around the rollers 6, 7 so as to bridge the rollers 6, 7, and a tension is applied to this sheet-feed belt 8 by the tension roller 10. The platen 18 is disposed at an area inside the sheet-feed belt 8 so as to support the sheet-feed belt 8 at a position facing the recording heads 1*a* and the treatment-liquid ejection head 1*b*. The belt roller 7 is a drive roller which is driven to be rotated by a motor, not shown, in a clockwise direction or a counterclockwise direction in FIG. 1, and the belt roller 6 is a driven roller which is rotated in accordance with a circulation of the sheet-feed belt 8 caused by the rotation of the belt roller 7. Accordingly, switching of the drive of the motor for driving the belt roller 7 allows the sheet feeding mechanism 16 to feed the sheet P placed on the sheet-feed belt 8 in the forward sheet feeding direction and the reverse sheet feeding direction.

The sheet P fed by the sheet feeding mechanism 16 in the forward sheet feeding direction is fed while being guided by a guide 29*a* and nipped by a pair of sheet-feed rollers 27. The pair of sheet-feed rollers 27 includes (a) a drive roller 27*a* configured to be driven to be rotated in the clockwise direction or the counterclockwise direction in FIG. 1 by a motor, not shown, and (b) a driven roller 27*b* configured to be driven to be rotated in accordance with the rotation of the drive roller 27*a*. Thus, the pair of sheet-feed rollers 27 can feed, while nipping, the sheet P in the forward sheet feeding direction and the reverse sheet feeding direction.

The sheet P fed by the pair of sheet-feed rollers 27 in the forward sheet feeding direction is fed while being guided by a guide 29*b* and nipped by a pair of sheet-feed rollers 28, and then discharged onto the sheet-discharge portion 15 from a sheet-discharge opening 22 formed in an upper portion of the casing 101*a*. On the other hand, the sheet P fed by the pair of sheet-feed rollers 27 in the reverse sheet feeding direction is fed to the sheet feeding mechanism 16 again. In this case, the sheet feeding mechanism 16 is changed to a state for feeding the sheet P in the reverse sheet feeding direction by a control of a controller 100 which will be described below. Thus, the sheet P fed to the sheet feeding mechanism 16 is fed in the reverse sheet feeding direction to the two-side recording mechanism 24 at a position located on a downstream side of the treatment-liquid ejection head 1*b* in the reverse sheet feeding direction.

The two-side recording mechanism 24 is mainly constituted by a plurality of pairs of sheet-resupply rollers 25 and a plurality of guides 26 for guiding the sheet P fed in the two-side recording mechanism 24. The two-side recording mechanism 24 is configured to feed the sheet P along a sheet flipping path indicated by white bold arrows in FIG. 1, whose two ends are connected to the sheet-feed path so as to form a loop. More specifically, in the two-side recording mechanism 24, the sheet P is fed through the sheet flipping path in a state in which one of faces of the sheet P that is a front face before the sheet is fed to the two-side recording mechanism 24 faces outward. Thus, the sheet P fed to the two-side recording mechanism 24 through the sheet-feed path in the reverse sheet feeding direction by the sheet feeding mechanism 16 is again fed to the sheet-feed path from a position between the sheet feeding mechanism 16 and the pair of sheet-feed rollers 14 in a state in which the sheet P is flipped over, that is, front and back faces of the sheet P are reversed to each other.

Each of the five heads 1 has a generally rectangular parallelepiped shape elongated in a main scanning direction in which each head 1 is reciprocated. These heads 1 are fixed so as to be arranged in the sheet feeding direction. That is, this printer 101 is a line-type printer in which the sheet feeding direction and the main scanning direction are perpendicular to each other. It is noted that the four recording heads 1*a* are arranged in order of cyan, magenta, yellow, and black from the upstream side in the forward sheet feeding direction.

Each head 1 includes a head main body 2 in which a plurality of liquid-ejection openings 108 as first or second liquid-ejection openings (with reference to FIGS. 3 and 4) for ejecting the ink or the treatment liquid. Each of the four ink tanks 17*a* stores therein the ink of a corresponding one of the colors, and the treatment-liquid tank 17*b* stores therein the treatment liquid. The ink of cyan, magenta, yellow, and black, and the treatment liquid are respectively supplied from these ink tanks 17*a* and treatment-liquid tank 17*b* to the head main bodies 2.

The liquid-ejection openings 108 are opened in a liquid-ejection face 2*a*, i.e., a lower face, of each of the head main bodies 2. The ink or the treatment liquid supplied to the head main body 2 reaches the liquid-ejection openings 108. When the sheet P fed by the sheet feeding mechanism 16 in the forward sheet feeding direction passes through a position just under the five heads 1, the treatment liquid and the ink of the four colors are ejected in order onto an upper face of the sheet P from the liquid-ejection openings 108. As a result, a desired color image is formed on the upper face of the sheet P, i.e., one of the faces of the sheet P which faces upward on the sheet-feed belt 8. It is noted that each liquid-ejection face 2*a* is a flat shape also elongated in the main scanning direction. Further, the liquid-ejection openings 108 are arranged in the liquid-ejection face 2*a* in the main scanning direction within a range equal to or longer than a length of the sheet P in the main scanning direction such that the image is formed on an entirety of the sheet P.

Figure 2:
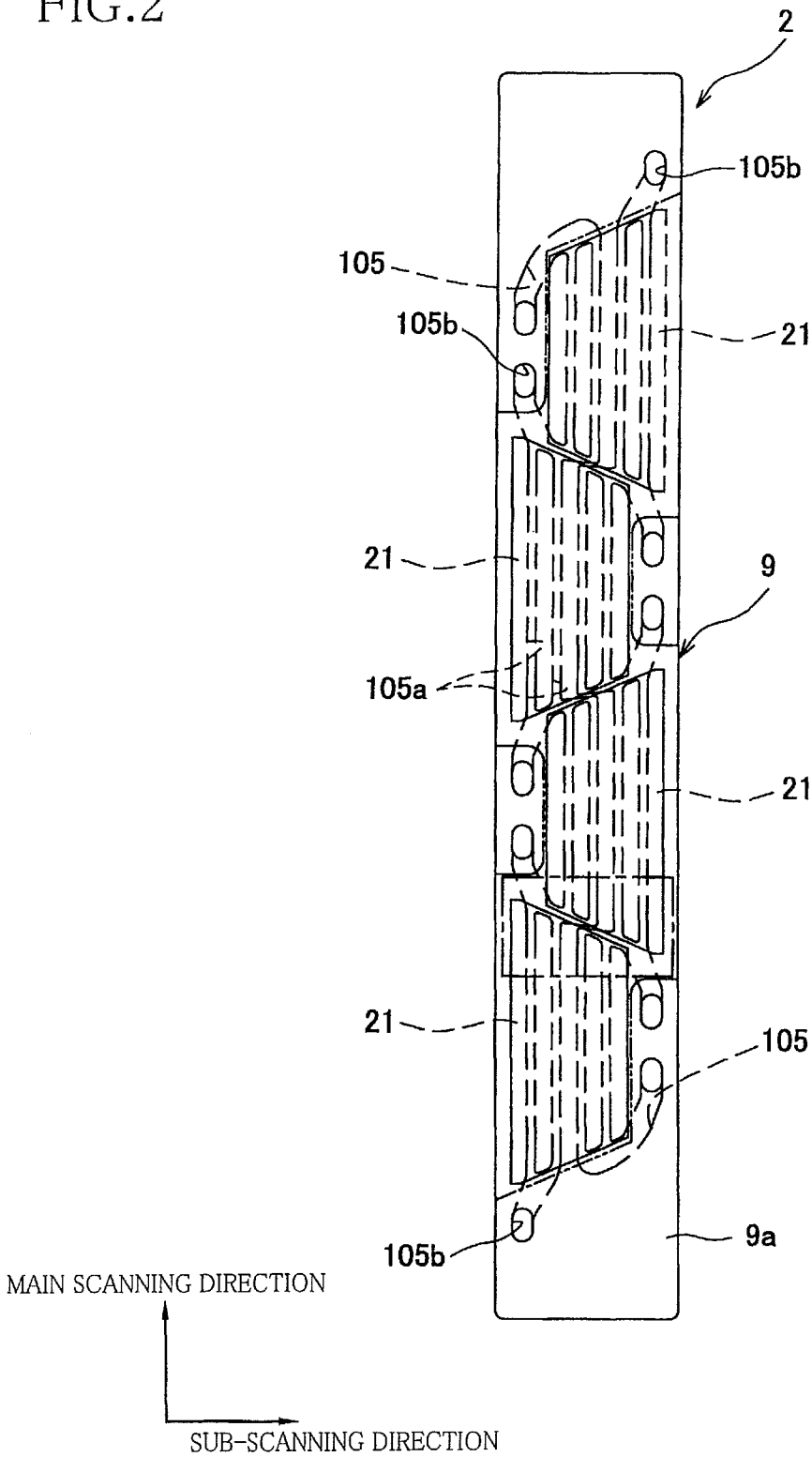
FIG. 2 is a plan view of a head main body shown in FIG. 1.
Figure 3:
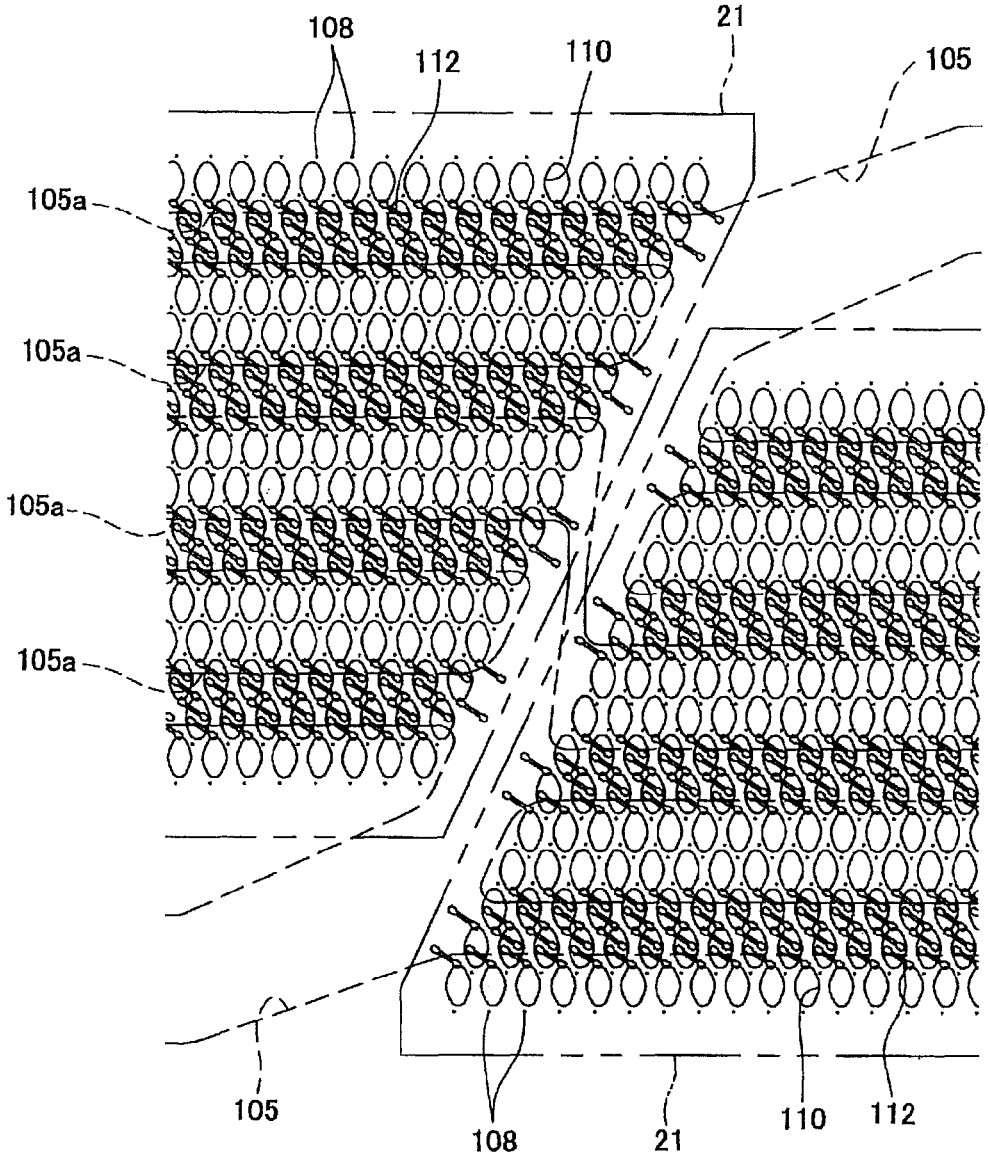
FIG. 3 is an enlarged view of an area enclosed with a one-dot chain line in FIG. 2.
Figure 4:
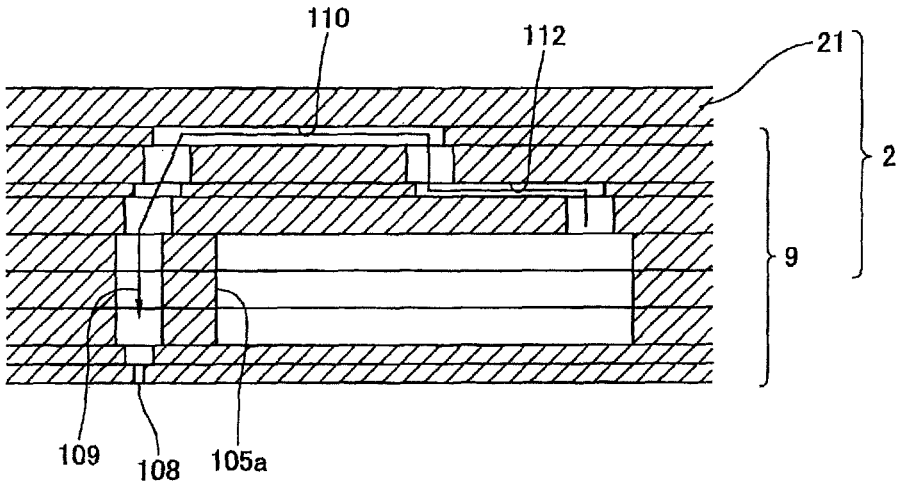
FIG. 4 is a cross-sectional view partially showing the head main body shown in FIG. 2.

There will be next explained the head main bodies 2 in detail with reference to FIGS. 2 to 4. It is noted that, in FIG. 3, pressure chambers 110, apertures 112, and the liquid-ejection openings 108 are illustrated by solid lines for easier understanding purposes though these elements are located under actuator units 21 and thus should be illustrated by broken lines.

As shown in FIG. 2, each head main body 2 is a stacked body in which the four actuator units (as a first or a second energy generating portion) 21 are fixed to an upper face 9*a* of a channel unit 9. It is noted that, though not shown, each of the recording heads 1*a* and the treatment-liquid ejection head 1*b* includes, in addition to the head main body 2, reservoir units for storing the ink or the treatment liquid supplied to the channel unit 9, a Flexible Printed Circuit (FPC) for supplying drive signals to the actuator units 21, a controlling board for controlling an driver IC mounted on the FPC, and so on.

As shown in FIG. 4, the channel unit 9 has a laminar structure in which a plurality of metal plates made of stainless steel are positioned to one another. In the channel unit 9, there are formed individual ink channels 109 extending from manifold channels 105 (with reference to FIGS. 2 and 3) to sub-manifold channels 105*a* and further extending from outlets of the respective sub-manifold channels 105*a* to the liquid-ejection openings 108 via the apertures 112 and the pressure chambers 110. Each of the actuator units 21 includes a plurality of actuators respectively corresponding to the pressure chambers 110 and has a function for applying ejection energy selectively to the ink in the pressure chambers 110.

As shown in FIG. 2, ten liquid-supply openings 105*b* are opened in the upper face 9*a* of the channel unit 9 in correspondence with ink-outlet channels of the reservoir units. A lower face of the channel unit 9 is the liquid-ejection face 2*a*, and the plurality of liquid-ejection openings 108 are arranged in matrix in the lower face of the channel unit 9. It is noted that the liquid-ejection openings 108 are arranged so as to be spaced to one another in the main scanning direction at 600 dpi which is a resolution in the main scanning direction.

Each of the recording heads 1*a* and the treatment-liquid ejection head 1*b* has the head main body 2 described above. Intervals of the ejection of the ink from the recording head 1*a* are controlled by an image-recording controlling section 35 and a flushing controlling section 36 described below such that the ink ejected from the liquid-ejection openings 108 is landed on the sheet P at distances of 600 dpi in a sub-scanning direction perpendicular to the main scanning direction. Intervals of the ejection of the treatment liquid from the treatment-liquid ejection head 1*b* are controlled by a precoat controlling section 40 described below such that the treatment liquid ejected from the liquid-ejection openings 108 is landed on the sheet P at distances of 600 dpi in the sub-scanning direction. That is, in the present embodiment, each of the resolution in the main scanning direction and a resolution in the sub-scanning direction is 600 dpi, and the sheet P is virtually partitioned into a plurality of dot areas in a grid pattern, each of which has a square shape whose length is 1/600 inch in the main scanning direction and the sub-scanning direction.

It is noted that, in the present embodiment, the image-recording controlling section 35 and the flushing controlling section 36 described below adjust an amount of the ink ejected from each liquid-ejection opening 108 of the recording heads 1*a* in three levels, namely, a large droplet, a medium-size droplet, and a small droplet. Likewise, the precoat controlling section 40 described below adjusts an amount of the treatment liquid ejected from each liquid-ejection opening 108 of the treatment-liquid ejection head 1*b* in the three levels, namely, the large droplet, the medium-size droplet, and the small droplet.

Figure 5:
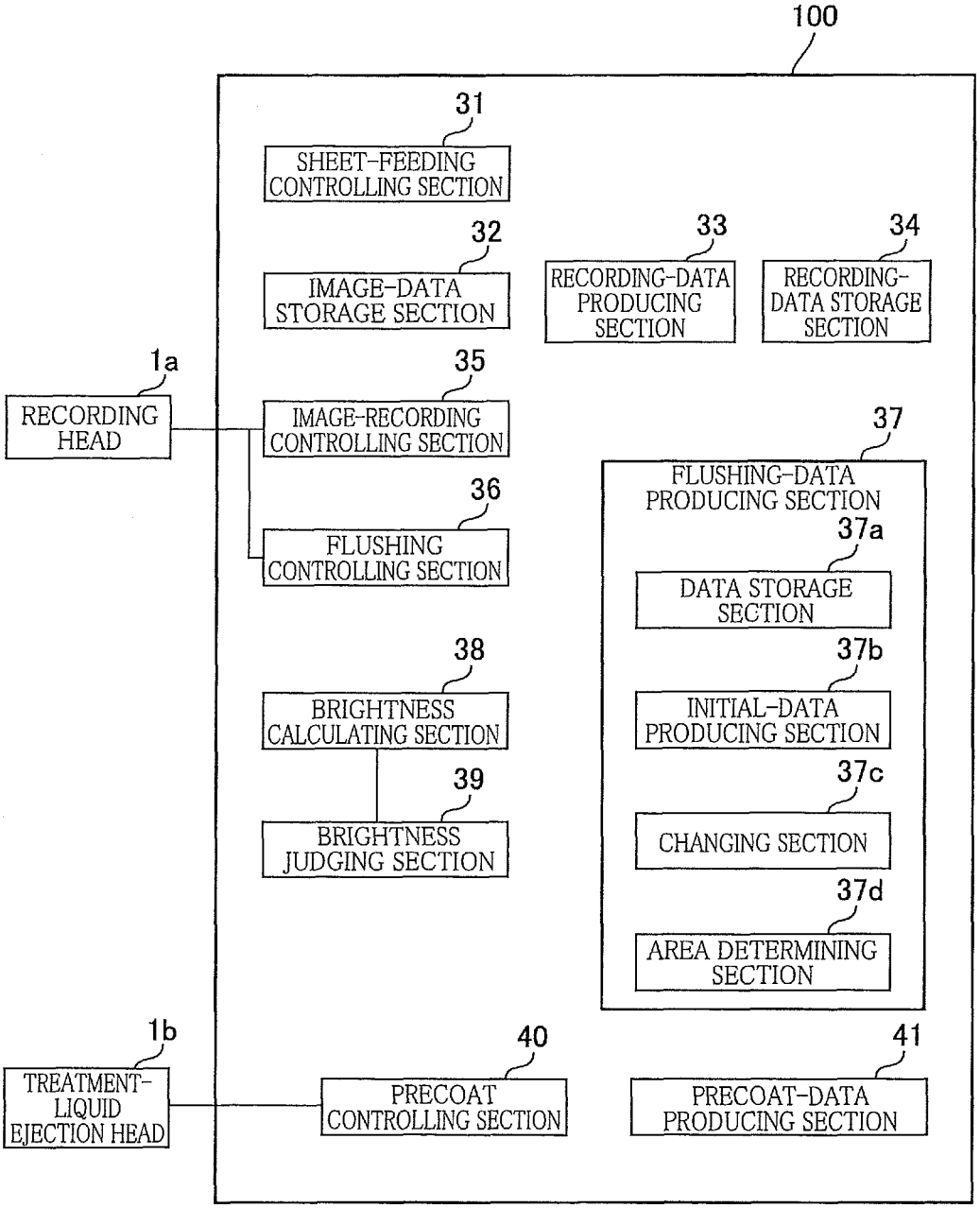
FIG. 5 is a block diagram showing functions of a controller shown in FIG. 1.

Further, as shown in FIG. 1, in the casing 101*a* is disposed the controller 100 configured to control entire operations of the ink-jet printer 101. Hereinafter, there will be explained the controller 100 with reference to FIG. 5. The controller 100 includes a Central Processing Unit (CPU), an Electrically Erasable and Programmable Read Only Memory (EEPROM) for rewritably storing programs executed by the CPU and data used for the programs, and a Random Access Memory (RAM) for temporarily storing data during execution of the programs. The controller 100 includes various functioning sections which are constituted by cooperation of these hardwares and softwares in the EEPROM with each other. Specifically, as shown in FIG. 5, the controller 100 includes a sheet-feeding controlling section 31, an image-data storage section 32, a recording-data producing section 33, a recording-data storage section 34, the image-recording controlling section 35, the flushing controlling section 36, a flushing-data producing section 37, a brightness calculating section 38, a brightness judging section 39, the precoat controlling section 40 as a second-liquid controlling section, and a precoat-data producing section 41 as a second-liquid ejection data producing section.

The sheet-feeding controlling section 31 controls a plurality of motors, not shown, for respectively driving the sheet-supply roller 12, the pair of sheet-feed rollers 14, the belt roller 7, the pair of sheet-feed rollers 27, the pair of sheet-feed rollers 28, and the pairs of sheet-resupply rollers 25. Specifically, where the image is to be recorded on only one of the faces (i.e., sides) of the sheet P, that is, one-side recording is performed, the sheet-feeding controlling section 31 controls the motors such that the uppermost one of the sheets P accommodated in the sheet-supply tray 11 is supplied, then fed through the position between the five heads 1 and the sheet-feed belt 8, and finally discharged from the sheet-discharge opening 22. Where the two-side recording is performed, the sheet-feeding controlling section 31 controls the motors such that the sheet P is supplied from the sheet-supply tray 11, fed to a downstream side of the heads 1 in the forward sheet feeding direction, then fed in the reverse sheet feeding direction to the two-side recording mechanism 24 to be flipped over in the two-side recording mechanism 24, then fed again in the forward sheet feeding direction, and finally discharged from the sheet-discharge opening 22.

The image-data storage section 32 stores therein image data transmitted from, e.g., a personal computer (PC) connected to the ink-jet printer 101. This image data is expressed in CMYK color model, for example. The image data includes a plurality of dot data which respectively correspond to the dot areas on the sheet P and each of which has gray-scale values for cyan, magenta, yellow, and black, each ranged from 0 to 255. In the present embodiment, a size of the image data corresponds to one page of the sheet P in the case of the one-side recording and corresponds to two pages (both faces) of the sheet P in the case of the two-side recording. However, the size or a range of the image data in the present invention is not limited to the case in the present embodiment, and the size of the image data may be smaller than one page of the sheet P in the case of the one-side recording.

The recording-data producing section 33 produces recording data by using an error diffusion method on the basis of each dot data of the image data stored in the image-data storage section 32. The recording data is dot data which represent a gray-scale value corresponding to an amount of the ink of each color to be landed on each dot area. Specifically, the recording-data producing section 33 produces, by converting gray-scale information of the dot data included in the image data into four values by using three thresholds (a large threshold, a medium threshold, and a small threshold in this embodiment), the recording data representing whether the ink is to be landed on each dot area for each color or not and which one of the large droplet, the medium-size droplet, and the small droplet of the ink is used where the ink is to be landed. Further, the recording-data producing section 33 calculates, for each dot area, an error between the gray-scale value in the image data and the gray-scale value corresponding to the ink amount (which corresponds to one of the large droplet, the medium-size droplet, the small droplet, and non-ejection) in the recording data. Then, the recording-data producing section 33 distributes the calculated error to dot data corresponding to dot areas located near the dot area corresponding to the dot data for which the calculation is performed. It is noted that, in the present embodiment, the recording-data producing section 33 distributes the calculated error to dot data corresponding to an area within one dot area around the dot area corresponding to the dot data for which the calculation is performed.

Figure 6:
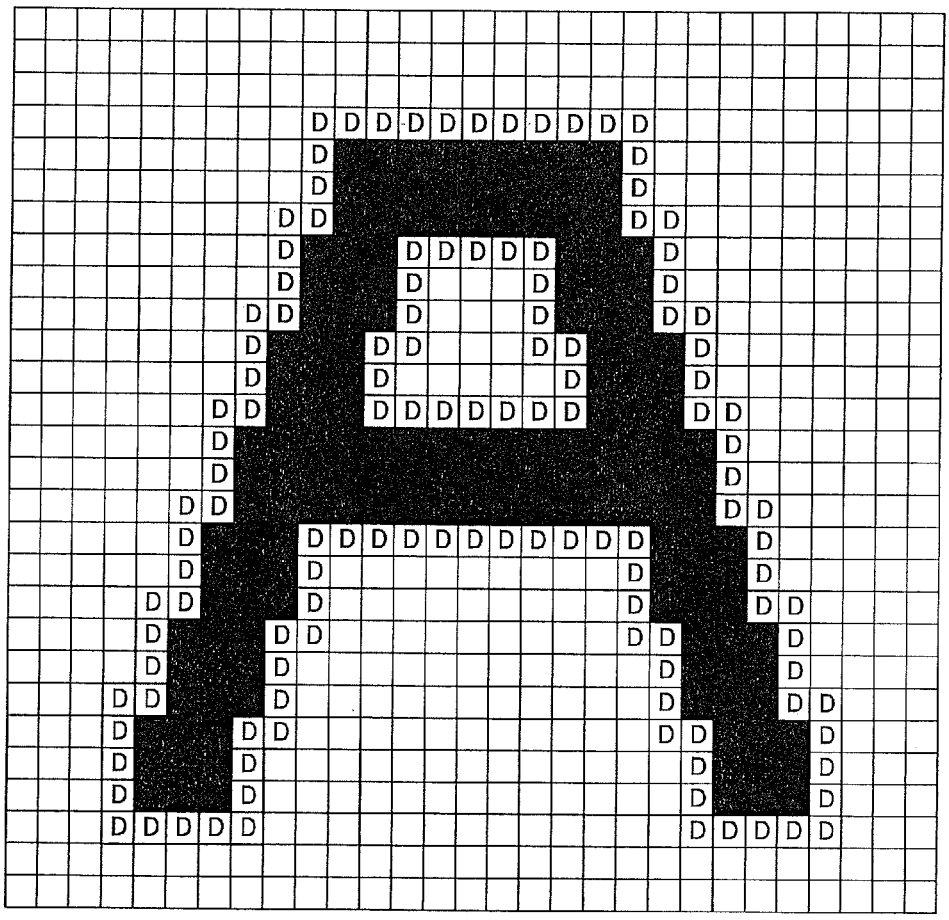
FIG. 6 is a view for explaining production of recording data by a recording-data producing section shown in FIG. 5.

As described above, in the present embodiment, the error diffusion method is used when the recording data is produced on the basis of the image data. Thus, as shown in FIG. 6, error-distributed dot areas (with "D" described thereon in FIG. 6) to each of which the error between the gray-scale value in the image data and the gray-scale value in the recording data is to be distributed are disposed around image dot areas (shown as black dot areas) on each of which the image is to be formed on the basis of the image data. That is, the error-distributed dot areas are disposed on the area within one dot area around edge dot areas each of which is one of the image dot areas that is adjacent to at least one background dot area (shown as white dot area).

The recording-data storage section 34 stores therein the recording data produced by the recording-data producing section 33. The image-recording controlling section 35 controls the actuators of the actuator units 21 of each recording head 1*a* on the basis of the recording data stored in the recording-data storage section 34.

The flushing controlling section 36 controls the actuators of the actuator units 21 of each recording head 1*a* on the basis of flushing data of the ink produced by the flushing-data producing section 37 in order to perform flushing for ejecting onto the sheet P ink which adheres to positions of the liquid-ejection face 2*a* near the respective liquid-ejection openings 108 and whose viscosity has been increased.

The flushing-data producing section 37 includes a data storage section 37*a*, an initial-data producing section 37*b* as a temporary-data producing section, a changing section 37*c* as a data changing section, and an area determining section 37*d*. The data storage section 37*a* stores therein data about dot areas on which flushing dots are to be formed.

Figure 7A:
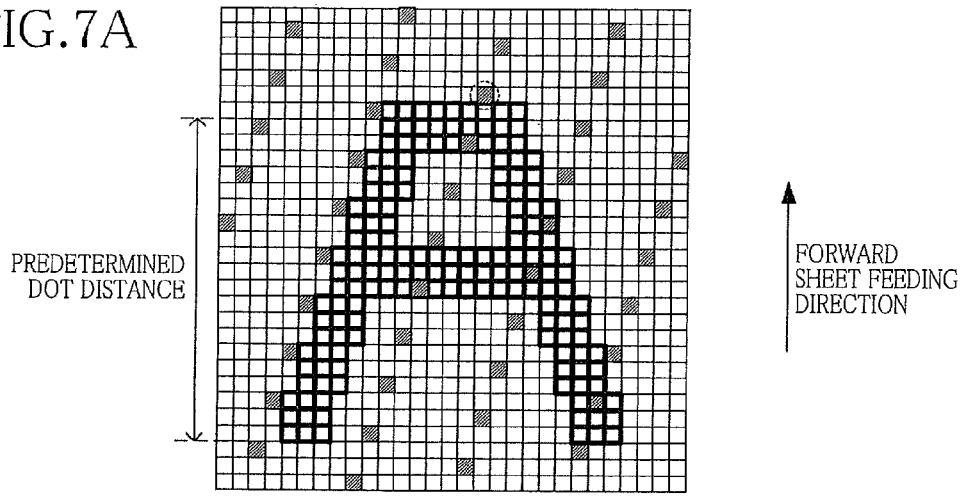
FIGS. 7A-7C are views showing a process that a flushing-data producing section shown in FIG. 5 determines an area in which a flushing dot is to be formed.

The initial-data producing section 37*b* temporarily determines flushing dot areas each of which is a dot area on which the flushing dot is to be formed. Specifically, the initial-data producing section 37*b* determines flushing dot areas at predetermined dot distances (intervals) obtained by multiplying a feeding speed of the sheet P stored in the sheet-feeding controlling section 31 by a predetermined length of time and stores the determined dot areas into the data storage section 37*a*. That is, as shown in FIG. 7A, the flushing dot areas (shown as diagonally shaded dot areas in FIG. 7A) are arranged on the dot areas defined on the sheet P so as to be spaced at regular intervals of the predetermined dot distance in the forward sheet feeding direction. As a result, there can be established a state that there is no liquid-ejection opening 108 in which a non-ejection time as a length of time in which the ink is not ejected is equal to or longer than a predetermined length of time. It is noted that this predetermined length of time varies with a color of the ink, an ambient temperature and humidity, and the like.

The changing section 37*c* changes, where there is any dot area located in an elimination area determined by the area determining section 37*d* among the dot areas stored in the data storage section 37*a*, the data stored in the data storage section 37*a* such that the dot distance, obtained by multiplying the feeding speed of the sheet P by a length of time of time interval between a flushing dot ejected in the last time and a flushing dot ejected in this time, for the liquid-ejection opening 108 through which is ejected the ink onto the dot area on which the ink is to be landed is made shorter than that at a time before the changing section 37 changes the data. That is, the dot area located in the elimination area is moved to a downstream side in the forward sheet feeding direction (i.e., in a direction in which an interval of the ejection of the ink onto the dot area is made shorter, in other words, a direction in which the ink is ejected earlier). Further, in this time, where the distance of any two of the dot areas in the forward sheet feeding direction is equal to or longer than the predetermined dot distance among other dot areas stored in the data storage section 37*a*, that is, where there is a possibility that there is any liquid-ejection opening 108 in which the non-ejection time is equal to or longer than the predetermined length of time, the changing section 37*c* changes the data so as to newly add the flushing dot areas such that there is no liquid-ejection opening 108 in which the non-ejection time is equal to or longer than the predetermined length of time. That is, the changing section 37 is configured to change the data such that the non-ejection time in one of the liquid-ejection openings 108 in which the non-ejection time is changed so as to be shorter than the non-ejection time at the time before the data is changed is shorter than the predetermined length of time.

Further, where there are dot areas adjacent to each other among the dot areas stored in the data storage section 37*a*, the changing section 37*c* changes the data stored in the data storage section 37*a* such that a position of one of the dot areas adjacent to each other is changed to a dot area located on a downstream side thereof in the forward sheet feeding direction.

Further, where there are two dot areas which are stored in the data storing section 36*a* and which overlap with each other on both faces of the sheet P when the two-side recording is performed, the changing section 37*c* changes the data stored in the data storage section 37*a* such that a position of one of the two dot areas is changed to a dot area located on a downstream side thereof in the forward sheet feeding direction.

The area determining section 37*d* determines a size of the elimination area. The elimination area is a specific area (i.e., a specific range) adjacent to the edge dot areas each of which is a dot area corresponding to an edge of the image based on the image data stored in the image-data storage section 32 (that is, each of the edge dot areas is one of the image dot areas that is adjacent to at least one background dot area). Specifically, the area determining section 37*d* determines the error-distributed dot area as the elimination area where any of four conditions described below are not satisfied. That is, in this case, the area determining section 37*d* determines, as the elimination area, a first area within one dot area around each edge dot area. It is noted that an area within one dot area around each edge dot area is an area which includes (a) an area adjacent to or contacting the edge dot area and (b) the edge dot area itself. Further, an area within two dot areas around each edge dot area is an area which includes (a) an area adjacent to or contacting the edge dot area, (b) an area adjacent to or contacting the area adjacent to the edge dot area, and (c) the edge dot area itself. Further, where at least one of the four conditions is satisfied, the area determining section 37*d* determines, as the elimination area, a second area within two dot areas around each edge dot area. In the following explanation, there will be described the four conditions.

The first condition is that the ink landed on the sheet P has a property of easily spreading. In the present embodiment, ease of the spreading of the ink is judged by a type of the sheet P, a type of the ink, and humidity of the sheet P. Specifically, for example, the ease of the spreading is judged on the basis of the type of the sheet P obtained from a sense of a sheet-type sensor or an input of a user by using data in which the type of the sheet P and the ease of the spreading are related to each other i.e., data storing a content that the ink easily spreads on the sheet P on which feathering and breeding are easily caused and that the ink does not easily spread on the other types of the sheet P. Similar data is prepared for each of the type of the ink and the humidity of the sheet P, and the ease of the spreading is judged on the basis of the sense of the sensor or the input of the user.

The second condition is that a line of the image including data corresponding to the edge dot area located at the nearest position to the flushing dot area is thin. That is, the line is judged as a thin line where a thickness of the line of the image including data corresponding to the edge dot area is equal to or smaller than a predetermined threshold.

The third condition is that brightness of an image dot to be formed on the edge dot area located at the nearest position to a dot area on which a certain flushing dot is to be formed is higher than that of the certain flushing dot. It is noted that the judgment of a high and low relationship in brightness is performed using a result of a judgment of the brightness judging section 39.

The fourth condition is that an amount of the treatment liquid to be landed on the edge dot area located at the nearest position to the flushing dot area is relatively large. In the present embodiment, where the large droplet of the treatment liquid is to be landed on the edge dot area, the amount of the treatment liquid is judged to be relatively large.

The brightness calculating section 38 calculates brightness of each of the image dots and the flushing dots to be formed on the sheet P on the basis of the color and the amount of the ink ejected from the liquid-ejection openings 108 of each recording head 1*a*. Specifically, as shown in the table in FIG. 8, weights are assigned to the respective ink colors in order from a deep one, that is, "1" is assigned to black, "2" to magenta, "3" to cyan, and "4" to yellow. Further, weights are assigned to the ink amounts in order from a large amount, that is, "1" is assigned to the large droplet, "2" to the medium-size droplet, and "3" to the small droplet. The brightness calculating section 38 calculates the brightness by multiplying the weight of the ink color and the weight of the ink amount together. That is, in the case of a yellow medium-size droplet, the brightness is eight (4×2), and in the case of a black small droplet, the brightness is three (1×3), for example.

The brightness judging section 39 judges a high and low relationship in brightness between two dots formed on the sheet P on the basis of a result of the calculation of the brightness calculating section 38. That is, when comparing the image dot formed by the yellow medium-size droplet and the flushing dot formed by the black small droplet, for example, the brightness judging section 39 judges that the flushing dot is lower in brightness than the image dot because the brightness of the image dot is eight while the brightness of the flushing dot is three as described above.

The precoat controlling section 40 controls the actuators of the actuator units 21 of the treatment-liquid ejection head 1*b* on the basis of data produced by the precoat-data producing section 41. The precoat-data producing section 41 produces the data concerning the dot areas on which the treatment liquid is to be landed and the amount of the treatment liquid to be ejected. The precoat-data producing section 41 produces the data such that the treatment liquid is landed on dot areas on which the ink is to be landed (i.e., dot areas on which image dots are respectively to be formed) on the sheet P on the basis of the control of the image-recording controlling section 35 among the plurality of the dot areas. Further, the precoat-data producing section 41 produces the data such that the amount of the treatment liquid to be ejected on a certain dot area increases with increase in the amount of the ink for constituting the image dot to be formed on the certain dot area.

Figure 9:
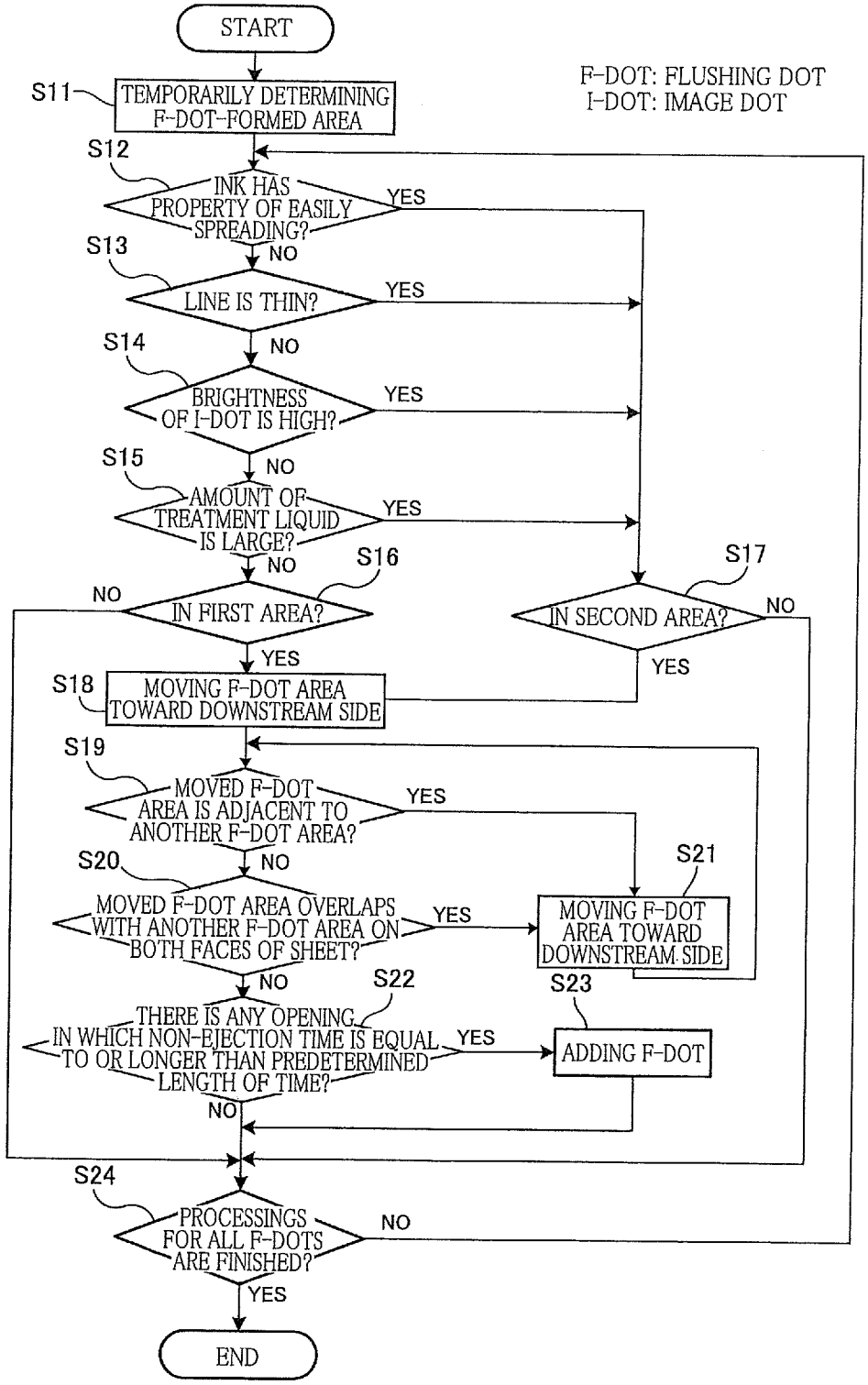
FIG. 9 is a flow-chart showing an example of a processing performed by the flushing-data producing section shown in FIG. 5.

There will be next explained, with reference to FIG. 9, an example of a processing performed by the flushing-data producing section 37 of the controller 100 when the images are formed on the both faces of the sheet P in the printer 101. It is noted that a processing for storing the image data into the image-data storage section 32 and a processing for producing data about the ejection of the treatment liquid by the precoat-data producing section 41 are performed before the processing shown in FIG. 9. In the present embodiment, the image data stored into the image-data storage section 32 is made equal to or larger than one page in a unit of one page in the case of the one-side recording and is made a size constituted by even-numbered pages in a unit of two pages (i.e., both sides) of the sheet Pin the case of the two-side recording. However, the size of the image data is not limited to this case in the present embodiment, and the image data may be made smaller than one page of the sheet P in the case of the one-side recording.

Initially, as shown in FIG. 7A, the initial-data producing section 37*b* temporarily determines in S11 the flushing dot areas for the stored image data such that the flushing dots are formed on the sheet P so as to be spaced to one another by the predetermined dot distances (intervals) in the forward sheet feeding direction. It is noted that, in the present embodiment, the initial-data producing section 37*b* temporarily determines the flushing dot areas independently of the image data. The flushing dot areas (i.e., the flushing data) temporarily determined in S11 are stored into the data storage section 37*a*. In the following processing, processings in S12 to S21 are performed in order on the basis of data included in the flushing data determined in S11.

Then, in S12 to S15, the controller 100 judges the four conditions so as to have the area determining section 37*d* determine the elimination area. That is, in S12, the controller 100 judges whether the ink landed on the sheet P easily spreads or not. Then, in S13, the controller 100 judges whether the line of the image including the data corresponding to the edge dot area located at the nearest position to the flushing dot area is thin or not. Then, in S14, the controller 100 judges whether the brightness of the image dot to be formed on the edge dot area located at the nearest position to the dot area on which a certain flushing dot is to be foamed is higher than that of the certain flushing dot or not. Then, in S15, the controller 100 judges whether the amount of the treatment liquid to be landed on the edge dot area located at the nearest position to the flushing dot area is relatively large or not.

Where any of the above-described four conditions is not satisfied (S12-S15: NO), the area determining section 37*d* determines the first area as the elimination area. Then, in S16, the controller 100 judges whether the dot area on which the flushing dot is to be formed is located in the first area or not. Where the dot area is not located in the first area (S16: NO), this processing goes to S24 described below. Where the dot area is located in the first area (S16: YES), this processing goes to S18.

On the other hand, where at least one of the four conditions is satisfied (any of S12-S15: YES), the area determining section 37*d* determines the second area as the elimination area. Then, in S17, the controller 100 judges whether the dot area on which the flushing dot is to be formed is located in the second area or not. Where the dot area is not located in the second area (S17: NO), this processing goes to S24 described below. Where the dot area is located in the second area (S17: YES), this processing goes to S18.

Figure 7B:
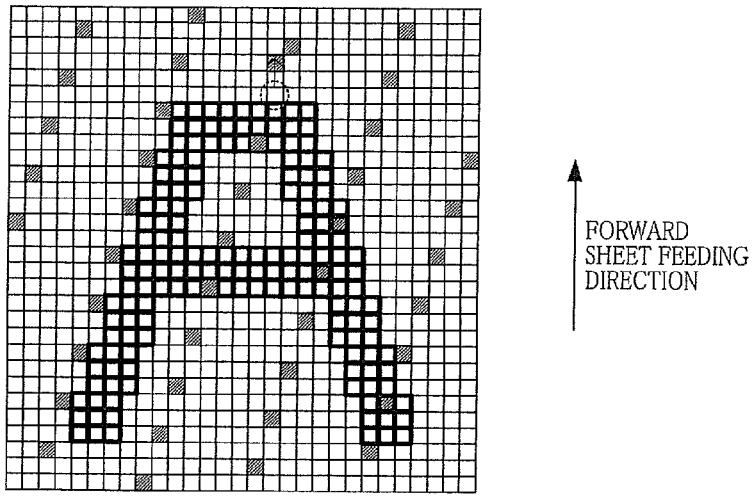

Then, in S18, the controller 100 changes the data stored in the data storage section 37*a* such that the flushing dot area located in the elimination area is moved to an outside of the elimination area toward a downstream side in the forward sheet feeding direction. Here, there will be considered a flushing dot area enclosed with a broken-line circle in FIG. 7A. The flushing dot area is adjacent to edge dot areas of the image dot areas (each enclosed by bold line) on which the image is to be formed on the basis of the image data. It is noted that the elimination area of this flushing dot area is the second area, i.e., an area within two dot areas around the edge dot area. Thus, as shown in FIG. 7B, this flushing dot area is moved by two dot areas toward the downstream side in the forward sheet feeding direction by the processing of S18.

Then, in S19, the controller 100 judges whether the flushing dot area moved in S18 is adjacent to any of the other flushing dot areas or not. Where the flushing dot area moved in S18 is adjacent to any of the other flushing dot areas (S19: YES), the processing goes to S21 described below. On the other hand, where the flushing dot area moved in S18 is not adjacent to any of the other flushing dot areas (S19: NO), the controller 100 judges in S20 whether or not the flushing dot area moved in S18 overlaps with any flushing dot area on a face of the sheet P reverse to the other face thereof on which the moved flushing dot is to be formed. Where the flushing dot areas overlap with each other on both faces of the sheet P (S20: YES), the processing goes to S21.

In S21, the controller 100 changes the data stored in the data storage section 37*a* such that the flushing dot area is moved toward the downstream side in the forward sheet feeding direction to a position at which the flushing dot areas are not adjacent to each other or a position at which the flushing dot areas do not overlap with each other on both faces of the sheet P. Here, as shown in FIG. 7B, there is a flushing dot area at a diagonally upper right position of the flushing dot area moved in S18, and these flushing dot areas are adjacent to each other. Thus, as shown in FIG. 7C, the flushing dot area moved in S18 is further moved by three dot areas toward the downstream side in the forward sheet feeding direction so as not to adjacent to any other flushing dot area.

On the other hand, where the flushing dot areas do not overlap with each other on both faces of the sheet P (S20: NO), the controller 100 judges in S22 on the basis of data about all the flushing dot areas stored in the data storage section 37*a* whether or not there is any liquid-ejection opening 108 in which the non-ejection time is equal to or longer than the predetermined length of time. It is noted that, in the present embodiment, the controller 100 judges whether or not there is any liquid-ejection opening 108 in which a distance between the flushing dots in the forward sheet feeding direction is equal to or larger than the predetermined dot distance instead of the judgment whether or not there is any liquid-ejection opening 108 in which the non-ejection time for which the ink is not ejected is equal to or longer than the predetermined length of time. Where there is any liquid-ejection opening 108 in which the non-ejection time is equal to or longer than the predetermined length of time (S22: YES), the controller 100 changes in S23 the data stored in the data storage section 37*a* such that a flushing dot area is newly added such that the liquid-ejection opening 108 in which the non-ejection time is equal to or longer than the predetermined length of time does not exist.

Figure 7C:
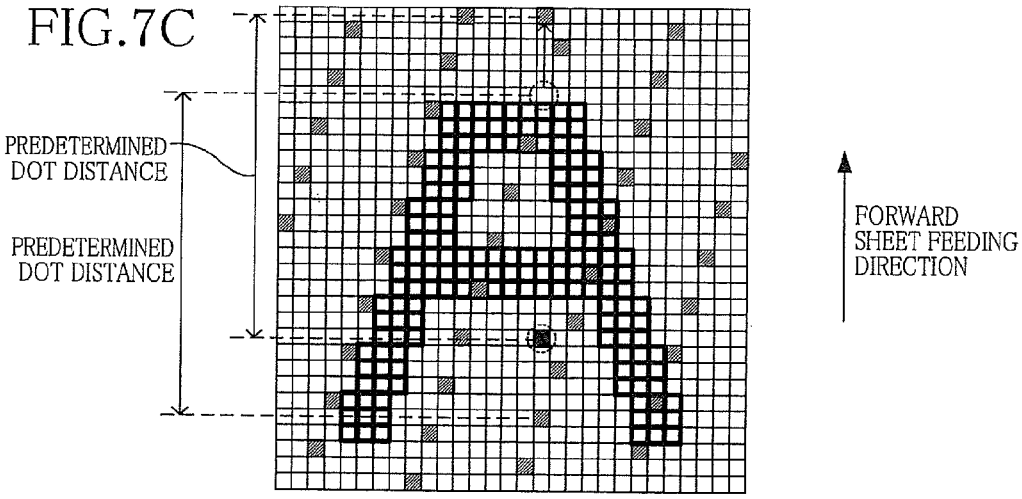

As shown in FIG. 7C, a distance between the flushing dot area moved in S18 and S21 and a flushing dot area located on an upstream side of the moved flushing dot area in the forward sheet feeding direction is equal to or longer than the predetermined dot distance. That is, a non-ejection time of the liquid-ejection opening 108 for ejecting the ink onto this flushing dot area is equal to or longer than the predetermined length of time. Thus, a dot area (i.e., a black dot area in FIG. 7C) located at a position distant from the flushing dot area by the predetermined distance on an upstream side thereof in the forward sheet feeding direction is added as a new flushing dot area, whereby the liquid-ejection opening 108 in which the non-ejection time is equal to or longer than the predetermined length of time does not exist.

Where there is no liquid-ejection opening 108 in which the non-ejection time is equal to or longer than the predetermined length of time (S22: NO), the controller 100 judges in S24 whether the controller 100 has performed the processings in S12 to S21 for all the data about the flushing dot areas stored in the data storage section 37*a* or not. Where there is any data in which any of the processings in S12 to S21 is not performed (S24: NO), this processing returns to S12. On the other hand, where the processings for all the data are finished (S24: YES), the data stored in the data storage section 37*a* is determined or confirmed.

As described above, in the ink-jet printer 101 as the present embodiment, no flushing dot is formed on the elimination area on the dot areas within at least one dot area around each edge dot area corresponding to the edge of the image based on the image data stored in the image-data storage section 32. Thus, there can be prevented that the flushing dot is formed on a position near the edge of the image, thereby restraining that the edge of the image is blurred by perception and recognition of the flushing dot as a part of the edge of the image. Thus, it is possible to improve visibility of the edge of the image without any complicated control.

Further, the ink-jet printer 101 as the present embodiment includes the area determining section 37*d* configured to determine, as the elimination area, the first area within one dot area around the edge dot area where no condition is satisfied, and determine, as the elimination area, the second area within two dot areas around the edge dot area where at least one condition is satisfied, on the basis of the four conditions as to whether the ink landed on the sheet P has the property of easily spreading or not, whether the line of the image is thin or not, whether the brightness of the image dot to be formed on the edge dot area located at the nearest position to the dot area on which a certain flushing dot is to be formed is higher than that of the certain flushing dot or not, and whether the amount of the treatment liquid to be landed on the edge dot area is relatively large or not. Thus, it is possible to appropriately determine the elimination area in accordance with the content of the image, recording conditions, and so on. That is, it is possible to determine the elimination area as a relatively large area in any of the cases where the edge of the image is easily blurred, where it is important to keep the visibility of the edge of the image at a relatively high level, and where the flushing dot is easily noticed by a viewer, for example.

Further, in the ink-jet printer 101 as the present embodiment, the area determining section 37*d* determines, as the first area of the elimination area, an area to which the error of data corresponding to the edge dot area is distributed, when the recording-data producing section 33 produces the recording data by using the error diffusion method on the basis of the image data. Thus, it is possible to prevent that the flushing dot formed at a position near the edge dot area becomes conspicuous by overlapping with the image dot formed by the error diffusion.

Further, in the ink-jet printer 101 as the present embodiment, where there is any flushing dot area in the elimination area among the flushing dot areas stored in the data storage section 37*a*, the data stored in the data storage section 37*a* is changed such that the non-ejection time of the ink ejected from the liquid-ejection opening 108 to the dot area is shorter than that at a time before the change of the data. Thus, the non-ejection time of each liquid-ejection opening 108 can be kept shorter than the predetermined length of time, thereby improving the visibility of the edge of the image while ensuring ejection properties. Further, in this case, the data stored in the data storage section 37*a* is changed such that no liquid-ejection opening 108 in which the non-ejection time is equal to or longer than the predetermined length of time exists for the data about the other flushing dot areas stored in the data storage section 37*a*. Thus, there can be prevented occurring of a case in which, when the non-ejection time of the liquid-ejection opening 108 is changed to be shorter, a non-ejection time is made longer in another data, and thereby the ejection properties are deteriorated.

In addition, in the ink-jet printer 101 as the present embodiment, where there are flushing dot areas adjacent to each other among the flushing dot areas stored in the data storage section 37*a*, the data stored in the data storage section 37*a* is changed such that one of the flushing dot areas adjacent to each other is moved to a dot area not adjacent to any other flushing dot areas. Thus, it is possible to prevent that the flushing dots become conspicuous by being adjacent to each other.

Further, in the ink-jet printer 101 as the present embodiment, where there are flushing dot areas overlapping with each other on both sides of the sheet P among the flushing dot areas stored in the data storage section 37*a* when the two-side recording is performed, the data stored in the data storage section 37*a* is changed such that one of the flushing dot areas is moved to the dot area not overlapping with any other flushing dot area. Thus, it is possible to prevent that the flushing dots become conspicuous by overlapping each other on both faces of the sheet P.

Further, in the ink-jet printer 101 as the present embodiment, each of the recording heads 1*a* is a line-type head elongated in the main scanning direction perpendicular to the sheet feeding direction and fixedly provided. In the case of using the fixed line-type head, ejection of the ink onto the sheet P is especially required upon the flushing. Thus, it is advantageous to apply the present invention to the ink-jet printer 101 as the present embodiment.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

Figure 10:
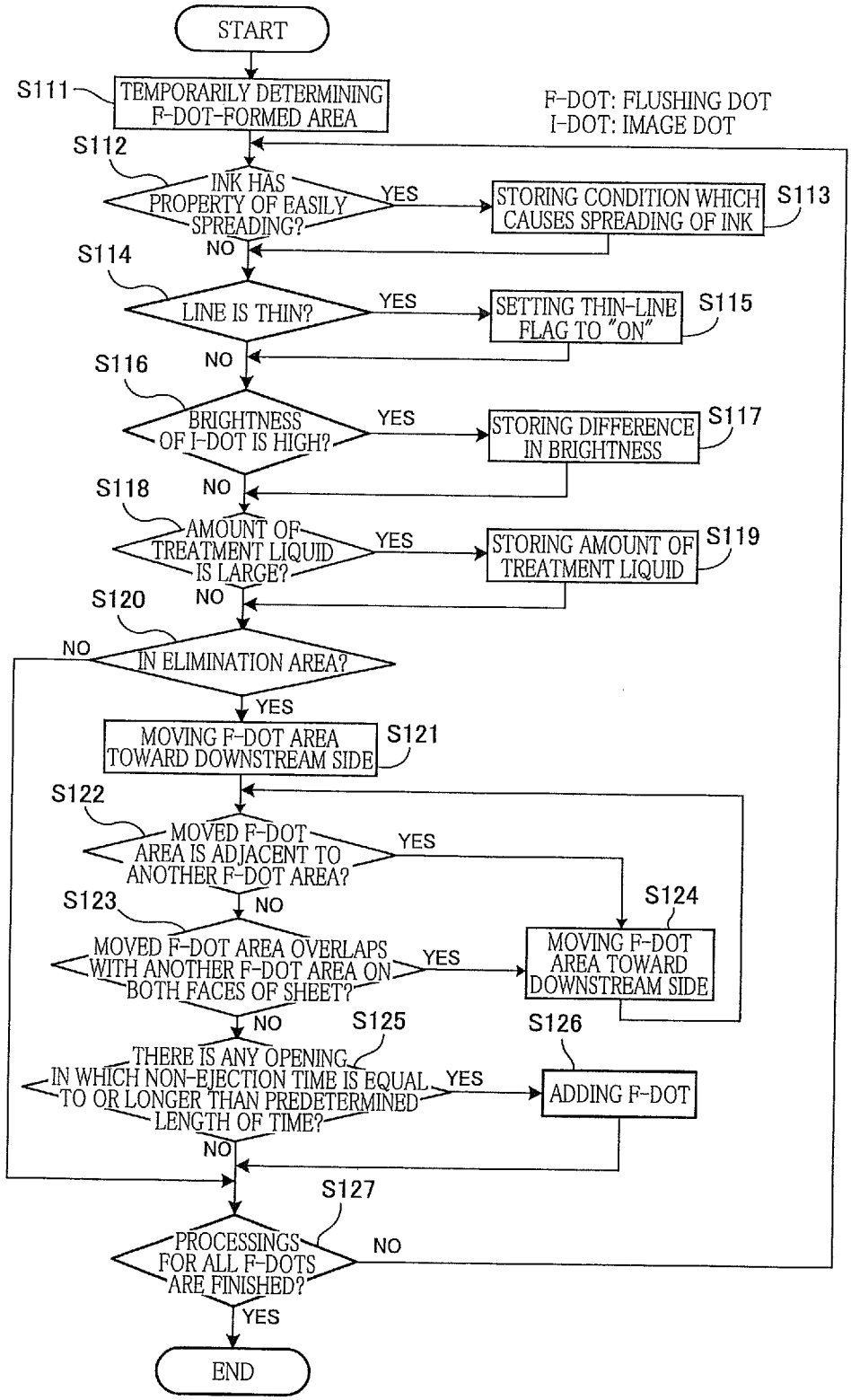
FIG. 10 is a flow-chart showing a modification of the processing performed by the flushing-data producing section of the ink-jet printer as the embodiment of the present invention.

For example, in the above-described embodiment, when the area determining section 37*d* determines the elimination area, the four conditions are judged in order, and the area determining section 37*d* determines the first area as the elimination area where any of the conditions is not satisfied and determines the second area as the elimination area where at least one condition is satisfied, but the processing performed by the area determining section 37*d* is not limited to this case. Here, there will be explained a modification of the processing performed by the area determining section 37*d* with reference to FIG. 10. In S112, the controller 100 judges whether the ink landed on the sheet P easily spreads or not. Where the controller 100 has judged that the ink easily spreads (S112: YES), the controller 100 stores in S113 a condition leading to the ease of spreading such as the type of the sheet P. Then, in S114, the controller 100 judges whether the line of the image is thin or not as the second condition. Where the controller 100 has judged that the line of the image is thin (S114: YES), the controller 100 sets a thin-line flag to "ON" in S115. Then, in S116, the controller 100 judges whether the brightness of the image dot to be formed on the edge dot area is higher than that of the flushing dot or not as the third condition. Where the controller 100 has judged that the brightness of the image dot is higher than that of the flushing dot (S116: YES), the controller 100 stores in S117 a difference between the brightness of the image dot and the brightness of the flushing dot. Then, in S118, the controller 100 judges whether the amount of the treatment liquid to be landed on the edge dot area is relatively large or not as the fourth condition. Where the controller 100 has judged that the amount of the treatment liquid is relatively large (S118: YES), the controller 100 stores in S119 the amount of the treatment liquid. Then, in S120, the controller 100 determines an appropriate elimination area, e.g., a size of the elimination area (the number of the dot areas), on the basis of the contents stored in S113, S115, S117, and S119 and judges whether the flushing dot is located in the elimination area or not. That is, the controller 100 determines, as the elimination area, an area corresponding to a condition in which the elimination area needs to be determined to be the largest, considering the four conditions, namely, the degree of the ease of the spreading, the thin line or not, a degree of the difference in brightness, and the amount of the treatment liquid. It is noted that each of unexplained processings or steps in FIG. 10 is identical with a corresponding one of the processings or steps explained in the above-described embodiment, and an explanation thereof is dispensed with.

Further, in the above-described embodiment, the controller 100 includes, as controlling sections for controlling the actuators included in the actuator units 21 of each recording head 1*a*, (a) the image-recording controlling section 35 configured to perform the control on the basis of the recording data stored in the recording-data storage section 34 and (b) the flushing controlling section 36 configured to perform the control on the basis of the flushing data produced by the flushing-data producing section 37, but the present invention is not limited to this configuration. That is, this ink-jet printer 101 may be configured such that a single controlling section performs a control on the basis of ejection data including the recording data and the flushing data.

Further, in the above-described embodiment, the precoat-data producing section 41 is configured to produce the data such that the treatment liquid is landed on the dot areas on which the ink is to be landed on the basis of the control of the image-recording controlling section 35 among the plurality of the dot areas on the sheet P, but the present invention is not limited to this configuration. For example, this ink-jet printer 101 may be configured such that the treatment liquid is also landed on dot areas around each dot area on which the ink is to be landed on the basis of the control of the image-recording controlling section 35. Where the ink-jet printer 101 is thus configured, a condition that an area which is adjacent to the edge dot areas and on which the treatment liquid is to be landed is relatively large is used as a fourth condition upon determining the elimination area by the area determining section 37*d* instead of the above-described fourth condition. That is, the area determining section 37*d* is configured to determine the elimination area such that the elimination area is larger in a situation where the area which is adjacent to the edge dot areas and on which the treatment liquid is to be landed is large than in a situation where the area is small.

Further, in the above-described embodiment, the controller 100 includes the area determining section 37*d* configured to determine the elimination area, but the area determining section 37*d* may be omitted. In this case, the elimination area is fixedly determined at a specific area distant from the edge dot areas by a distance equal to or larger than one dot area, for example.

Further, in the above-described embodiment, the area determining section 37*d* determines, as the first area of the elimination area, the area to which the error of the data corresponding to the edge dot area is distributed, when the recording-data producing section 33 produces the recording data by using the error diffusion method on the basis of the image data, but the present invention is not limited to this configuration. That is, the elimination area may be determined independently of the area to which the error is distributed.

Further, in the above-described embodiment, the recording-data producing section 33 produces the recording data by using the error diffusion method on the basis of the image data, but the present invention is not limited to this configuration. That is, a method of producing the recording data is not limited to the above-described method.

Further, in the above-described embodiment, the initial-data producing section 37*b* produces the flushing data independently of the image data such that the flushing dots are formed on the sheet P so as to be spaced one another at the predetermined dot distances (intervals), but the present invention is not limited to this configuration. That is, for example, the initial-data producing section 37*b* may produce the flushing data such that liquid-ejection openings 108 in which each interval of the ejection of the ink is equal to or longer than a predetermined length of time are searched on the basis of the intervals of the ejection of the ink based on the image data from each liquid-ejection opening 108 of the recording heads 1*a* by the control of the image-recording controlling section 35, and then the ink is ejected from the liquid-ejection openings 108 such that each interval of the ejection of the ink is shorter than the predetermined length of time, so as to form the flushing dots.

Further, in the above-described embodiment, where there is any flushing dot area in the elimination area, the flushing dot area is moved to an outside of the elimination area toward the downstream side in the forward sheet feeding direction, but the present invention is not limited to this configuration. For example, this ink-jet printer 101 may be configured in the following configuration. That is, the sheet P is virtually divided into a plurality of blocks each constituted by a plurality of dot areas, and a total amount of the ink to be ejected by each recording head 1*a* and landed on the sheet P on the basis of the control of the image-recording controlling section 35 is calculated in advance. Then, when the flushing dot area is moved, the flushing dot is moved to a block that is located on a downstream side of a block on which the flushing dot area is located, in the forward sheet feeding direction and that is a block in which a total amount of the ink to be landed on the block is relatively small.

Further, in the above-described embodiment, the ink-jet printer 101 includes the two-side recording mechanism 24 configured to turn upside down the sheet P for the two-side recording, but this two-side recording mechanism 24 may be omitted.

Further, in the above-described embodiment, there has been explained the line-type printer including the heads 1 elongated in the main scanning direction, but the present invention may be applied to a serial-type printer including heads movable in the main scanning direction.

Further, in the above-described embodiment, as shown in FIG. 7C, the dot area (i.e., the black dot area in FIG. 7C) located at the position distant from the moved flushing dot area by the predetermined distance on an upstream side thereof in the forward sheet feeding direction is added as the new flushing dot area, but the present invention is not limited to this configuration. For example, instead of the addition, the controller 100 may perform a processing in which a flushing dot area adjacent to the moved flushing dot area on an upstream side thereof in the forward sheet feeding direction is moved toward the downstream side in the forward sheet feeding direction such that a distance of the two flushing dots becomes the predetermined dot distance.

Further, in the above-described embodiment, the actuator units 21 are used as means for applying an ejection energy to the ink. As the actuator unit 21, a piezoelectric actuator of a unimorph type is used, for example. However, as the means for applying the ejection energy to the ink, there may be used a thermal-type means for performing image recording by heating liquid-form ink in nozzles by a heating element to generate bubbles and thereby pushing and ejecting the ink from the nozzles.

Further, in the above-described embodiment, the ink-jet printer 101 is configured such that the judgment as to whether the flushing dot is to be landed on the elimination area or not is performed for all the flushing dots to be ejected onto the sheet P, and where the flushing dot is to be landed on the elimination area, the position on which the flushing dot is to be landed is moved toward the downstream side in the feeding direction, while where the flushing dot is not to be landed on the elimination area, the position on which the flushing dot is to be landed is not changed, but the present invention is not limited to this configuration. For example, the ink-jet printer 101 may be configured such that the judgments are performed not for all the flushing dots but for only a part of the flushing dots, and the position on which the flushing dot is to be landed is changed on the basis of a result of the judgments. Citing one example, the ink-jet printer 101 may be configured such that the judgments are not performed for the flushing dot having a high brightness (e.g., the flushing dot ejected from the recording head 1*a* for ejecting the yellow ink) among the flushing dots to be ejected, and the judgments are performed only for the flushing dot having a low brightness (e.g., the flushing dot ejected from the recording head 1*a* for ejecting the black ink). Since the flushing dot of the ink having the low brightness has a high possibility of affecting the visibility of the edge of the image, the visibility of the image dot can be improved by not forming the flushing dot on the elimination area. On the other hand, since the flushing dot of the ink having the high brightness has a low possibility of affecting the visibility of the edge of the image, the deterioration of the visibility of the edge of the image is considered to be less frequently caused even where the flushing dot area is formed on the elimination area. As a result, where the flushing dot is not moved, time intervals of the ejection of the flushing dots can be made appropriate, thereby making it possible to restrain a reduced amount of the ink by the flushing dots.

What is claimed is:

1. A liquid ejecting apparatus, comprising:

a feeding mechanism configured to feed a recording medium in a feeding direction;

a first ejection head including (a) at least one first ejection opening through which is ejected first liquid for forming an image on the recording medium and (b) a first energy generating portion configured to generate an ejection energy for ejecting the first liquid through the at least one first ejection opening;

an image-data storage section configured to store image data externally inputted thereto as data for ejecting the first liquid onto a plurality of dot areas into which the recording medium is partitioned such that each of the plurality of dot areas has a first length corresponding to a recording resolution in a direction perpendicular to the feeding direction and a second length corresponding to a recording resolution in the feeding direction;

an image-recording controlling section configured to control the first energy generating portion of the first ejection head on the basis of the image data stored in the image-data storage section;

a flushing-data producing section configured to produce flushing data for a flushing operation of the first liquid; and a flushing controlling section configured to control the first energy generating portion of the first ejection head such that a flushing dot is formed on the recording medium on the basis of the flushing data which has been produced by the flushing-data producing section, wherein the flushing-data producing section is configured to produce the flushing data such that the flushing dot is landed on one of the plurality of dot areas which is distant, by a specific area equal to or larger than at least one dot area, from an edge dot area which is a dot area corresponding to an edge of the image based on the image data stored in the image-data storage section.

2. The liquid ejecting apparatus according to claim 1, wherein the flushing-data producing section is configured to produce the flushing data such that all flushing dots to be landed on the recording medium are landed on dot areas on the recording medium, the dot areas being distant from the edge dot area by the specific area.

3. The liquid ejecting apparatus according to claim 1, wherein the flushing-data producing section includes an area determining section configured to determine the specific area, and wherein the flushing-data producing section is configured to produce the flushing data on the basis of the specific area determined by the area determining section.

4. The liquid ejecting apparatus according to claim 3, wherein the image-recording controlling section is configured to control the first energy generating portion of the first ejection head on the basis of data into which the image data is converted using an error diffusion method, and wherein the area determining section is configured to determine, as the specific area, an area to which an error of data corresponding to the edge dot area is distributed.

5. The liquid ejecting apparatus according to claim 3, wherein the area determining section is configured to determine the specific area such that the specific area is larger in a situation where the first liquid to be landed on the recording medium has a property that a degree of ease of spreading of the first liquid over the recording medium is high than in a situation where the first liquid to be landed on the recording medium has a property that the degree of the ease of the spreading of the first liquid is low.

6. The liquid ejecting apparatus according to claim 3, wherein the area determining section is configured to determine the specific area such that the specific area is larger in a situation where a line of the image, at least a part of which is located on the edge dot area is thin than in a situation where the line is thick.

7. The liquid ejecting apparatus according to claim 3, wherein the area determining section is configured to determine the specific area such that the higher a brightness of an image dot to be formed on the edge dot area located at the nearest position to a dot area on which the flushing dot is to be formed in comparison with a brightness of the flushing dot, the larger the specific area is.

8. The liquid ejecting apparatus according to claim 3, further comprising:

a second ejection head including (a) at least one second ejection opening through which is ejected second liquid that is ejected on the recording medium and that lowers a degree of permeation of the first liquid into the recording medium and (b) a second energy generating portion configured to generate an ejection energy for ejecting the second liquid through the at least one second ejection opening;

a second-liquid ejection data producing section configured to produce ejection data for the second liquid on the basis of the image data stored in the image-data storage section; and a second-liquid controlling section configured to control the second energy generating portion of the second ejection head on the basis of the ejection data produced by the second-liquid ejection data producing section, wherein the area determining section is configured to determine the specific area such that the specific area is larger in a situation where an amount of the second liquid to be landed on the edge dot area by the control of the second-liquid controlling section is large than in a situation where the amount of the second liquid is small.

9. The liquid ejecting apparatus according to claim 3, further comprising:

a second ejection head including (a) at least one second ejection opening through which is ejected second liquid that is ejected on the recording medium and that lowers a degree of permeation of the first liquid into the recording medium and (b) a second energy generating portion configured to generate an ejection energy for ejecting the second liquid through the at least one second ejection opening;

a second-liquid ejection data producing section configured to produce ejection data for the second liquid on the basis of the image data stored in the image-data storage section; and a second-liquid controlling section configured to control the second energy generating portion of the second ejection head on the basis of the ejection data produced by the second-liquid ejection data producing section, wherein the area determining section is configured to determine the specific area such that the specific area is larger in a situation where a size of an area which is adjacent to the edge dot area and on which the second liquid ejected by the control of the second-liquid controlling section is to be landed is large than in a situation where the size of the area is small.

10. The liquid ejecting apparatus according to claim 3, wherein the flushing-data producing section includes:

a temporary-data producing section configured to produce temporary flushing data for the first liquid such that a non-ejection time in each of the at least one first ejection opening is not equal to or longer than a predetermined length of time, the non-ejection time being a length of time for which the ejection of the first liquid is not performed; and a data changing section configured to change the temporary flushing data where the first liquid ejected on the basis of the temporary flushing data produced by the temporary-data producing section is to be landed on the specific area determined by the area determining section.

11. The liquid ejecting apparatus according to claim 10, wherein the data changing section is configured to change the flushing data such that, where the flushing data is changed such that the non-ejection time of the at least one first ejection opening is made shorter than the non-ejection time at a time before the flushing data is changed, each non-ejection time of the at least one first ejection opening for which the ejection of the first liquid is not performed is not equal to or longer than the predetermined length of time, for part of the flushing data which is other than changed part of the flushing data of the at least one first ejection opening.

12. The liquid ejecting apparatus according to claim 3, wherein the flushing-data producing section is configured to produce the flushing data such that dot areas on which the flushing dots are respectively to be formed are not adjacent to each other.

13. The liquid ejecting apparatus according to claim 3, further comprising a two-side recording mechanism for recording images on both sides of the recording medium, wherein the flushing-data producing section is configured to produce the flushing data for the first liquid such that dot areas on which the first liquid ejected upon the flushing operation is to be landed do not overlap with each other on the both sides of the recording medium.

14. The liquid ejecting apparatus according to claim 3, wherein the first ejection head is a line-type head which is elongated in the direction perpendicular to the feeding direction and is not moved in the direction perpendicular to the feeding direction.

15. The liquid ejecting apparatus according to claim 1, wherein the flushing-data producing section includes:

a temporary-data producing section configured to produce temporary flushing data for the first liquid such that a non-ejection time in each of the at least one first ejection opening is not equal to or longer than a predetermined length of time, the non-ejection time being a length of time for which the ejection of the first liquid is not performed; and a data changing section configured to change the temporary flushing data where the first liquid ejected on the basis of the temporary flushing data produced by the temporary-data producing section is to be landed on the specific area.

16. The liquid ejecting apparatus according to claim 15, wherein the data changing section is configured to change the flushing data such that, where the flushing data is changed such that the non-ejection time of the at least one first ejection opening is made shorter than the non-ejection time at a time before the flushing data is changed, each non-ejection time of the at least one first ejection opening for which the ejection of the first liquid is not performed is not equal to or longer than the predetermined length of time, for part of the flushing data which is other than changed part of the flushing data of the at least one first ejection opening.

17. The liquid ejecting apparatus according to claim 1, wherein the flushing-data producing section is configured to produce the flushing data such that dot areas on which the flushing dots are respectively to be formed are not adjacent to each other.

18. The liquid ejecting apparatus according to claim 1, further comprising a two-side recording mechanism for recording images on both sides of the recording medium, wherein the flushing-data producing section is configured to produce the flushing data for the first liquid such that dot areas on which the first liquid ejected upon the flushing operation is to be landed do not overlap with each other on the both sides of the recording medium.

19. The liquid ejecting apparatus according to claim 1, wherein the first ejection head is a line-type head which is elongated in the direction perpendicular to the feeding direction and is not moved in the direction perpendicular to the feeding direction.

20. A liquid ejecting apparatus, comprising:

a feeding mechanism configured to feed a recording medium in a feeding direction;

an ejection head including (a) at least one ejection opening through which is ejected liquid for forming an image on the recording medium and (b) an energy generating device configured to generate an ejection energy for ejecting the liquid through the at least one ejection opening;

an image-data storage device configured to store image data externally inputted thereto as data for ejecting the liquid onto a plurality of dot areas into which the recording medium is partitioned such that each of the plurality of dot areas has a first length corresponding to a recording resolution in a direction perpendicular to the feeding direction and a second length corresponding to a recording resolution in the feeding direction; and a control device configured to:

control the energy generating device of the ejection head on the basis of the image data stored in the image-data storage device;

produce flushing data such that the flushing dot is landed on one of the plurality of dot areas which is distant, by a specific area equal to or larger than at least one dot area, from an edge dot area which is a dot area corresponding to an edge of the image based on the image data stored in the image-data storage device; and control the energy generating device of the ejection head such that a flushing dot is formed on the recording medium on the basis of the flushing data.

* * * * *